US007076975B2

(12) United States Patent
Heyder et al.

(10) Patent No.: US 7,076,975 B2
(45) Date of Patent: Jul. 18, 2006

(54) DRIVE APPARATUS FOR A WASHING MACHINE

(75) Inventors: Reinhard Heyder, Berlin (DE); Jörg Skrippek, Priort (DE)

(73) Assignee: BSH und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/186,719

(22) Filed: Jul. 1, 2002

(65) Prior Publication Data

US 2003/0015005 A1 Jan. 23, 2003

Related U.S. Application Data

(63) Continuation of application No. PCT/EP00/12301, filed on Dec. 6, 2000.

(51) Int. Cl.
*D06F 37/30* (2006.01)

(52) U.S. Cl. ..... 68/58; 68/140

(58) Field of Classification Search ..... 68/140, 68/12.16, 12.24, 24, 58; 310/156, 216, 261
See application file for complete search history.

(56) References Cited

U.S. PATENT DOCUMENTS

| | | | | |
|---|---|---|---|---|
| 2,777,963 | A * | 1/1957 | Kuntz | 310/86 |
| 3,428,842 | A * | 2/1969 | Harris | 310/217 |
| 3,465,186 | A * | 9/1969 | Armstrong et al. | 310/158 |
| 3,610,784 | A * | 10/1971 | Rundell | 417/395 |
| 3,766,416 | A * | 10/1973 | Papst et al. | 310/43 |
| 3,784,850 | A * | 1/1974 | Inaba et al. | 310/49 R |
| 3,840,764 | A * | 10/1974 | Burger | 310/185 |
| 4,060,744 | A * | 11/1977 | Starcevic | 310/91 |
| 4,292,557 | A * | 9/1981 | Kishi | 310/78 |
| 4,365,187 | A * | 12/1982 | McDaniel et al. | 318/254 |
| 4,446,706 | A | 5/1984 | Hartwig | |
| 4,486,677 | A * | 12/1984 | Yamamoto et al. | 310/64 |
| 4,829,205 | A * | 5/1989 | Lindgren | 310/166 |
| 4,982,130 | A * | 1/1991 | Cap et al. | 310/268 |
| 5,541,462 | A * | 7/1996 | Nii et al. | 310/90 |
| 5,672,927 | A * | 9/1997 | Viskochil | 310/194 |
| 5,862,686 | A * | 1/1999 | Skrippek | 68/140 |
| 5,886,436 | A * | 3/1999 | Schneider et al. | 310/89 |
| 5,894,746 | A * | 4/1999 | Skrippek | 68/140 |
| 5,957,671 | A * | 9/1999 | Outzen | 417/410.1 |
| 5,996,379 | A * | 12/1999 | Skrippek | 68/140 |
| 6,131,422 | A * | 10/2000 | Skrippek et al. | 68/140 |
| 6,341,507 | B1 * | 1/2002 | Rode et al. | 68/12.16 |
| 6,374,444 | B1 * | 4/2002 | Skrippek et al. | 8/159 |
| 6,407,472 | B1 * | 6/2002 | Takayanagi | 310/45 |

(Continued)

FOREIGN PATENT DOCUMENTS

DE 1945585 * 4/1970

(Continued)

OTHER PUBLICATIONS

European Patent Office 414,927 (Sprik) Aug. 1989.*

*Primary Examiner*—Frankie L. Stinson
(74) *Attorney, Agent, or Firm*—John T. Winburn; Russell W. Warnock; Craig J. Loest

(57) ABSTRACT

In a washing machine with a drive apparatus and a suds container on whose rear wall the drive apparatus is disposed, an isolation layer is provided between stator cores of the motor and a stator supporting part or a supporting element to suppress discharge currents that occur during high-frequency conversion in the motor.

30 Claims, 4 Drawing Sheets

U.S. PATENT DOCUMENTS

| | | | | |
|---|---|---|---|---|
| 6,446,473 | B1 * | 9/2002 | Park et al. | 68/156 |
| 6,477,869 | B1 * | 11/2002 | Heyder et al. | 68/140 |
| 6,626,014 | B1 * | 9/2003 | Heyder et al. | 68/140 |

FOREIGN PATENT DOCUMENTS

| | | | |
|---|---|---|---|
| DE | 197 26 246 | A1 | 12/1998 |
| DE | 199 37 229 | A1 | 2/2001 |
| EP | 0 413 915 | A1 | 2/1991 |
| EP | 0 947 622 | A2 | 10/1999 |
| JP | 55-162861 | * | 12/1980 |
| JP | 6-22525 | * | 1/1994 |
| JP | 7-178286 | * | 7/1995 |
| JP | 10-271719 | * | 10/1998 |
| JP | 11-342287 | * | 12/1999 |

* cited by examiner

DRIVE APPARATUS FOR A WASHING MACHINE

CROSS-REFERENCE TO RELATED APPLICATION

This application is a continuation of copending International Application No. PCT/EP00/12301, filed Dec. 6, 2000, which designated the United States and was not published in English.

BACKGROUND OF THE INVENTION

Field of the Invention

The invention relates to a drive apparatus for a washing machine having a washing drum driven by a motor that is disposed on a rear wall of a suds container and has a rotor, a supporting part, and stator cores.

A drive apparatus for a washing machine is disclosed in German Published, Non-Prosecuted Patent Application DE 199 37 229 A1. This document describes a drive apparatus for a washing machine having a washing drum that is mounted in a floating manner, is mounted at least approximately horizontally, and is driven through a drive shaft that is also fitted with the rotor of an electric motor, with the stator of the motor, including a stator supporting part and stator cores that themselves have laminated cores and windings, being mounted on the rear face of the suds container. According to one embodiment of the drive apparatus described in German Application DE 199 37 229 A1, a supporting body for the stator supporting part or the stator supporting part as an entity is produced from plastic. The suds container may also be composed entirely of plastic. If these measures are taken, the configuration effectively prevents discharge currents from flowing such as those that can occur due to capacitive effects in an electric motor with a converter drive or an electronically commutating D1 motor, that is to say, an electric motor with frequency conversion, at high conversion frequencies, for example, at 16 to 20 kHz.

This is because the region through which a direct current cannot pass and which is filled with air, between the rotor and the stator cores of the electric motor, is electrically conductive for a high-frequency alternating current at such a frequency. The current, which is also referred to as a discharge current, flows through electrically conductive parts of the washing machine either directly through the stator supporting part and through the suds container or indirectly through the rotor and its shaft and then through the suds container, provided the latter is composed of metal, to the protective ground contact. Although it is possible to use a stator supporting part composed of plastic to suppress such discharge currents, it is relatively complex, however, to use such plastic stator supporting parts because they do not have good dimensional stability.

SUMMARY OF THE INVENTION

It is accordingly an object of the invention to provide a drive apparatus for a washing machine that overcomes the hereinafore-mentioned disadvantages of the heretofore-known devices of this general type and that uses simple measures to suppress the flow of discharge currents.

With the foregoing and other objects in view, there is provided, in accordance with the invention, a drive apparatus for a washing machine having a suds container with a rear wall, a motor disposed on the rear wall and having live parts electrically isolated from the suds container, and a washing drum driven by the motor, the drive apparatus including a rotor to be connected to the washing drum, a supporting part, stator cores connected to the supporting part, and an isolation layer electrically isolating the live parts of the motor from the rear wall of the suds container. Isolation, as referred to herein, can also be insulation.

The invention achieves it objectives by electrically isolating live parts of the motor from the suds container.

The electrical isolation of the motor from the suds container can advantageously be achieved by an isolation layer on the rear wall of the suds container.

In accordance with another feature of the invention, the supporting part of the motor is electrically isolated from the rear wall of the suds container by an isolation layer. In addition, an isolation layer can also be provided that isolates the supporting part from the drive shaft.

In accordance with a further feature of the invention, a shaft connects the rotor to the washing drum, bearings surround the shaft, and the isolation layer isolates the supporting part from the rear wall, the shaft driving the washing drum, and/or the bearings surrounding the shaft.

In accordance with an added feature of the invention, the supporting part to be entirely surrounded by an isolation layer. The isolation layer is produced, by way of example, by extrusion coating of the supporting part.

In accordance with an additional feature of the invention, the stator cores are isolated from the supporting part by an isolation layer.

In accordance with yet another feature of the invention the supporting part includes a supporting element and a stator supporting part and the isolation layer is disposed between the stator cores, the supporting element, and the stator supporting part.

In accordance with yet a further feature of the invention, there are provided screws mounting the stator cores on the supporting part through screw holes having walls, the isolation layer isolating the walls from the stator core.

In accordance with yet an added feature of the invention the stator cores have field windings, the supporting part has an outer wall opposite the field windings, and the isolation layer is disposed on the outer wall opposite the field windings.

In accordance with yet an additional feature of the invention, the stator cores have a slot insulation layer, laminated cores, and field windings and the isolation layer supplements the slot insulation layer on the stator cores between the laminated cores and the field windings.

In accordance with again another feature of the invention, the isolation layer entirely surrounds each of the laminated cores.

Plastic or laminated paper can be used particularly advantageously as the electrically isolating media. A thermally conductive film, which is at the same time composed of an electrically insulating material, can also advantageously be used. In such a case, a thin layer of laminated paper or plastic is introduced between the laminated cores on one side and the stator supporting part on the other side.

The laminated cores are advantageously extrusion coated in their entirety by plastic. If they are connected by a metal screw to the stator supporting part, an electrically insulating layer can also be provided on the wall of each of the holes that hold the screws in the laminated core. This must also extend over the region that is covered by a nut that is screwed onto the screw.

A further measure for electrical isolation is to enlarge the distance between the end winding, that is to say, the windings that surround the laminated core, and the metallic parts, so that this distance is preferably greater than 0.5 cm.

In accordance with again a further feature of the invention, the rotor of the motor is at least partially of an electrically insulating material suppressing high-frequency discharge currents.

It is likewise advantageous for the rotor of the electric motor to be composed at least partially of an electrically insulating material to suppress high-frequency discharge currents. The rotor is preferably produced either entirely or at least partially from plastic. Soft iron plates, which are used as a magnetic return path, are disposed behind permanent magnets that are disposed in the rotor. These soft iron plates are preferably also introduced or injection molded into the plastic part, if the rotor is composed of plastic. Alternatively, the soft iron plates are adhesively bonded to the rotor bell.

If the rotor bell is composed of plastic, a connecting element for the shaft on whose end the rotor bell is fitted, a metallic part, for example, with a serrated tooth system or a cone, is injection molded in the plastic of the rotor bell, such that it cannot rotate.

In accordance with again an added feature of the invention, the rotor has permanent magnets and soft iron plates are disposed adjacent the permanent magnets in the rotor as a magnetic return path.

In accordance with again an additional feature of the invention, the rotor has soft iron plates in the plastic, preferably, the rotor has soft iron plates injected molded in the plastic.

In accordance with still another feature of the invention, there are provided parts holding electrical connections in a given position, the rotor being disposed at a distance of more than 3 mm from the parts hold the electrical connections.

The plastic bell is preferably configured to be at a distance of more than 3 mm from parts that hold the electrical connections or contacts in their position. If it is composed of plastic, the bearing bell has preferably rounded edges to achieve better flame resistance. If the bearing bell has ribs, these are preferably disposed on the inside, that is to say, on the side facing the stator cores. The ribs are, at the same time, used to cool the winding. Openings or apertures in the rotor may also be used for cooling. The rotor may also be constructed in the form of spokes.

The use of a plastic bell has the advantage that, in comparison to a metal bell, the production costs involved in manufacturing it are less, and that the plastic bell can more easily be configured to be optimal in terms of noise.

The invention is suitable not only for an electric motor that drives the washing drum directly but also for an electric motor of this type that drives the shaft of the washing drum through a transmission or pulley belt, provided that the electric motor is likewise disposed on the bottom wall of the suds container, as is disclosed, by way of example, from German Application DE 199 11 139 A1.

To suppress the flow of discharge currents, in accordance with a concomitant feature of the invention, an additional isolation layer, in addition to the already existing slot insulation, to be provided in each case between the end winding of a field winding and the laminated core. This may preferably be integral with the isolating plate, which is disposed between the laminated core and the nut.

Other features that are considered as characteristic for the invention are set forth in the appended claims.

Although the invention is illustrated and described herein as embodied in a drive apparatus for a washing machine, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
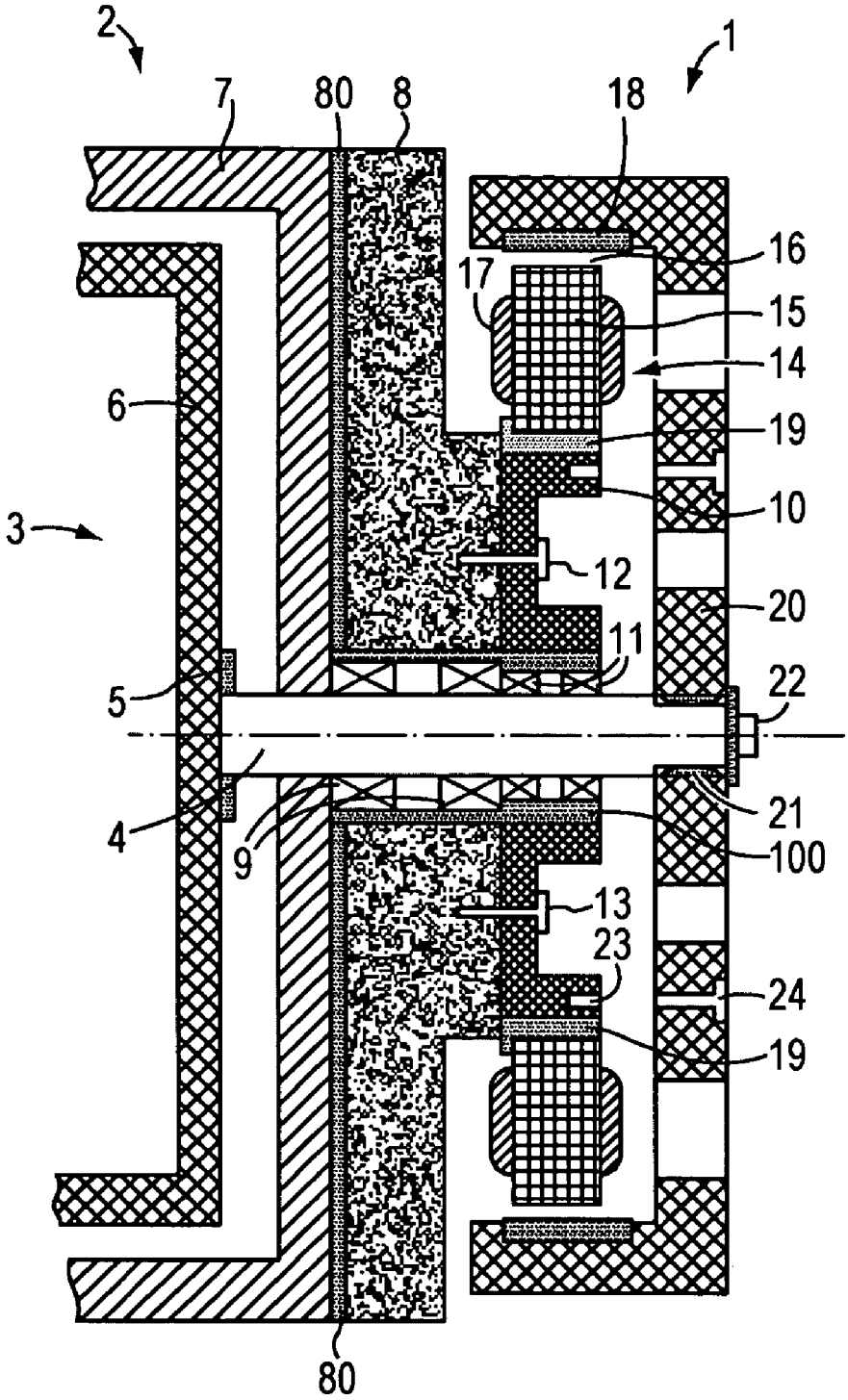
FIG. 1 is a cross-sectional view of a drive apparatus for a washing machine according to the invention.

Referring now to the figures of the drawings in detail and first, particularly to FIG. 1 thereof, there is shown a drive apparatus 1 disposed on the rear face of a suds container 2 in a washing machine. A washing drum 3 is mounted, such that it lies horizontally, through a shaft 4 in the interior of the suds container 2. The washing drum 3, that is to say a bottom wall 6 of the washing drum 3 is firmly connected to the shaft 4 through a mounting ring 5. Instead of the horizontal bearing system illustrated here, it is also possible to mount the washing drum 3 at an inclination angle of, for example, 150 to the horizontal. The washing drum 3 can likewise be disposed vertically on the shaft 4, so that the drive apparatus 1 is disposed underneath the suds container 2.

A stator support part 8 is mounted on the rear face of a rear wall 7 of the suds container 2. The stator supporting part 8 is used to hold the drive apparatus 1. The supporting part 8 is, for example, also in the form of a supporting star, and is connected to the suds container 2.

The shaft 4 is mounted through bearings 9 within the supporting part 8 such that it can rotate. A non-illustrated sealing ring is used for sealing between the rear wall 7 and the shaft 4.

The stator supporting part 8 has a supporting element 10 that is firmly connected to it, can be pushed on from the outside over the shaft 4 and is itself mounted through bearings 11 with respect to the shaft 4. It is firmly connected through attachment screws 12, 13 to the stator supporting part 8. The supporting element 10, like the stator supporting part 8 and the suds container 2, is composed of metal and is, thus, electrically conductive. Stator cores 14 are connected to the supporting element 10 and have laminated cores 15 that are surrounded by field windings 17. Because the currents that flow in the field windings 17 are at a high frequency, capacitive discharge currents flow out between the field windings 17 and the laminated cores 15 bridging the insulating sleeve surrounding the winding wire, and could flow through the supporting element 10, the stator supporting part 8 and through the suds container 2 to the housing of the washing machine, where they would represent a danger to the operator. An isolation layer 80 is, therefore, provided for electrical isolation of the stator supporting part 8 and of the supporting element 10 from the rear wall 7, and an isolation layer 100 is provided for electrical isolation from the shaft 4.

In addition to suppressing discharge currents, an isolation layer 19 is provided that is disposed between the laminated cores 15 and the supporting element 10 on one hand and between the laminated cores 15 and the stator supporting part 8 on the other hand. In any case, an insulating material must be provided between the component to which the stator cores 14 are fitted and the cores 14. This effectively prevents any flow of discharge currents.

Magnetic poles 18 are disposed on a rotor bell 20 separated from the stator cores by an air gap 16. This rotor bell 20 is connected through a serrated tooth system 21 to the shaft 4, and it is also connected to this shaft 4 through a central shaft screw 22, which projects into a corresponding threaded hole in the shaft 4. The supporting element 10 and the rotor bell 20 can be firmly connected to one another by locking screws during transportation, through threaded holes 23, 24 in the supporting element 10 and in the rotor bell 20.

Instead of the serrated tooth system 21, a profiled shaft, profiled hub, adjusting spring, or conical or splined shaft connection can also be provided for firm connection between the rotor bell 20 and the shaft 4. The rotor bell 20 is preferably likewise composed of plastic to prevent discharge currents from flowing as a result of any capacitive effect between the laminated cores 15 and the magnetic poles 18.

A single integral supporting part composed of a single material may also advantageously be used instead of the stator supporting part 8 and the supporting element 10, in order to mount the stator cores 14, 25 thereon.

In a further exemplary embodiment (FIG. 2*a*), a stator core 25 is firmly connected to a stator supporting part 27 through a screw 26. The stator core 25 has a laminated core 28 and field windings 29. The field windings 29 are additionally electrically isolated from the laminated core 28 by a separate isolation layer 30 in addition to the insulating sheaths, which are already present, on the wire that forms the field windings 29. Such a configuration reduces the capacitive effect of high-frequency currents. An isolation layer 32 is also disposed in a hole 31 within the laminated core 28, which is used to hold the attachment screw 26, and the isolation layer 32 prevents discharge currents from flowing from the stator core 25 to the stator supporting part 27. There is an isolation layer 33 on the side of the laminated core 28 facing the stator supporting part 27.

Figure 2A:
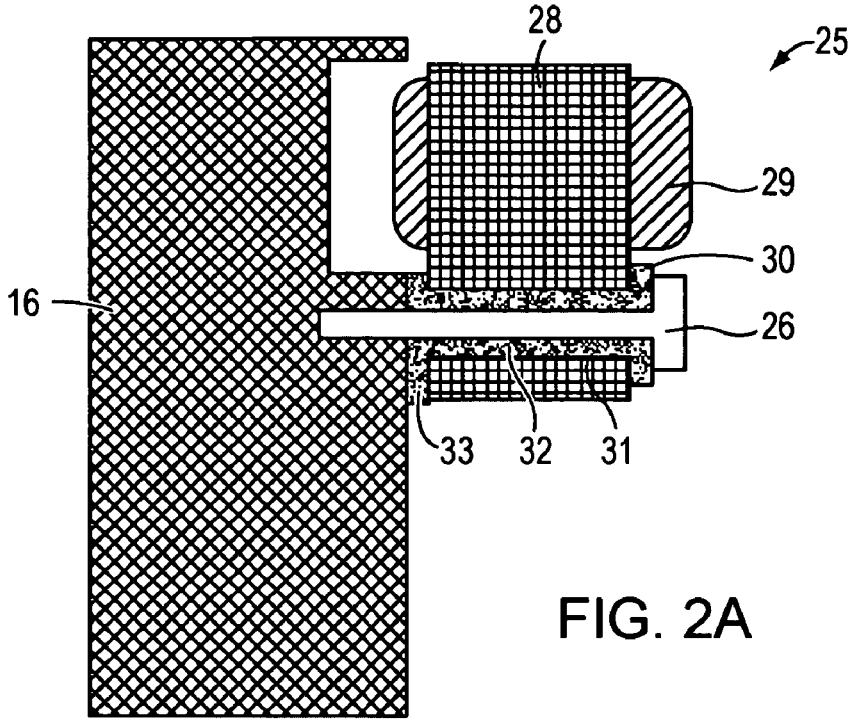
FIG. 2*a* is a fragmentary, cross-sectional view of a first embodiment of a stator core that is mounted on a stator supporting part of FIG. 2. and has an isolation layer provided according to the invention.
Figure 2B:
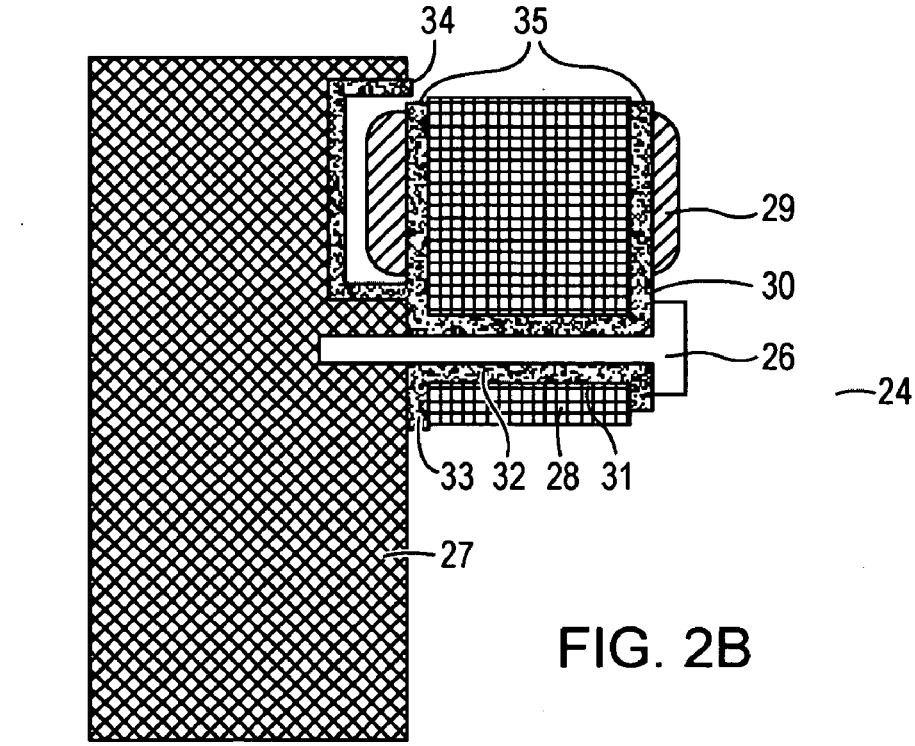
FIG. 2*b* is a fragmentary, cross-sectional view of a second embodiment of the stator core of FIG. 2*a;*
Figure 2C:
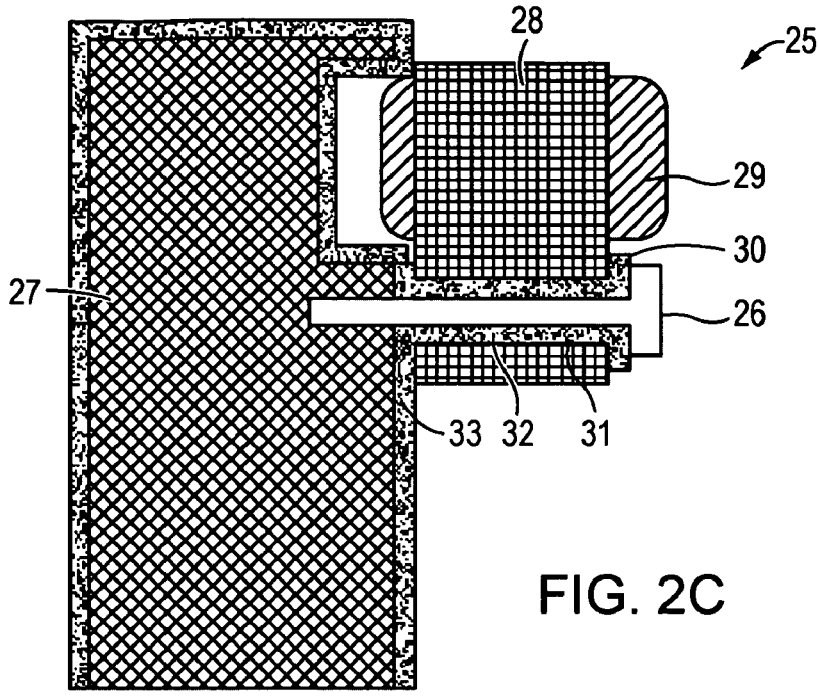
FIG. 2*c* is a fragmentary, cross-sectional view of a third embodiment of the stator core of FIG. 2*a*.
Figure 2D:
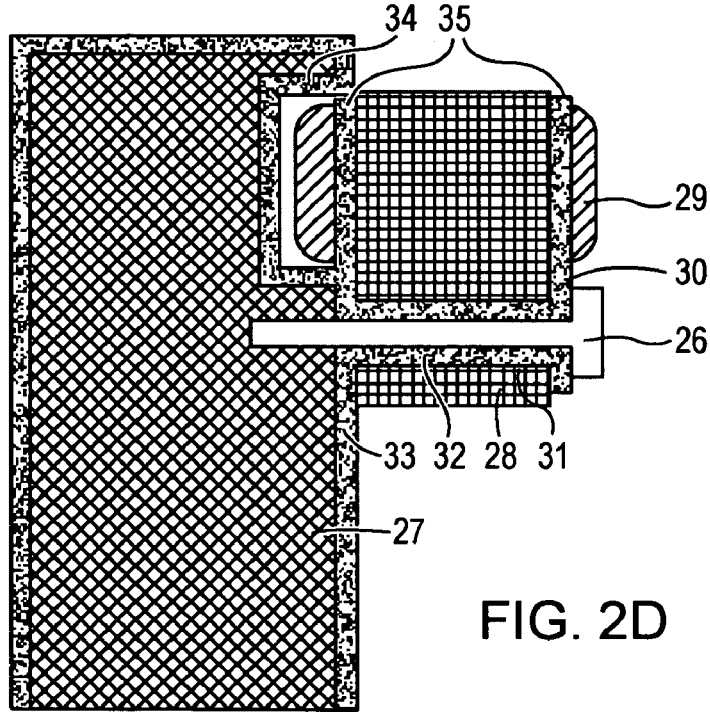
FIG. 2*d* is a fragmentary, cross-sectional view of a fourth embodiment of the stator core of FIG. 2*a*.

In a further exemplary embodiment (FIG. 2*b*), a further isolation layer 34 is disposed in addition to the insulation measures already illustrated in FIG. 2*a*, and electrically isolates the stator supporting part 27 from the stator core 25 with regard to discharge currents. In addition, as shown in FIG. 2*b*, it is possible to provide for an isolation layer 35 also to be disposed in the region between the laminated core 28 and the field winding 29 to achieve even better electrical isolation against capacitive effects.

All the measures described above may each be taken individually or in conjunction with one another to suppress discharge currents. There is, thus, no need for the stator supporting part 8, the supporting element 10, and the stator supporting part 27 to be formed entirely from plastic.

Figure 3:
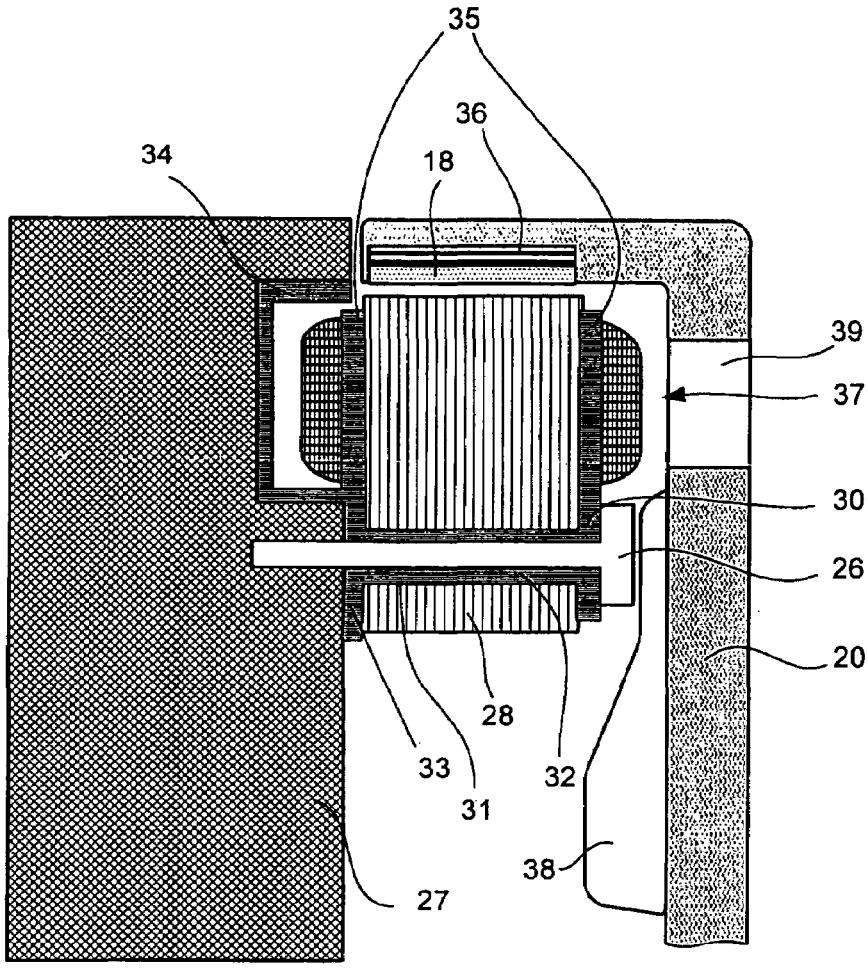

According to FIG. 3, the rotor 20 of the electrical motor can be made of plastic materials. Behind the magnetic poles 18 disposed in the rotor 20, in other words, between the magnetic poles 18 and the flange of the rotor bell 20, are soft iron plates 36 serving as a magnetic yoke (return path) These soft iron plates 36 are, preferably, also enclosed in the plastic material of the rotor 20 or injected. Alternatively, the soft iron plates 36 can be adhesively bonded to the rotor bell.

Preferably, the plastic rotor 20 is configured to have a distance of more than 3 mm to those parts holding electrically conducting connections in their position (for example, the stator cores 37 with their individual parts). The rotor bell 20 has, insofar as it is of plastic material, preferably, edges that are rounded off to increase inflammability. Additionally, the rotor bell 20 has ribs 38 on its inner side that face the side of the stator carrier part 27 provided with the stator cores 37. The ribs 38 are radially disposed and generate, during the rotation of the rotor 20, a strong blowing stream that cools the stator cores 37. Therefore, cooling air flows into the stator area through the openings of the stator (see FIG. 1) disposed in the vicinity of the shaft 4, and flows out through the openings 39 disposed in the rotor 20 in the vicinity of the stator cores 37.

We claim:

1. A drive apparatus for a washing machine having a suds container with a rear wall, a motor disposed on the rear wall and having live parts electrically isolated from the suds container, and a washing drum driven by the motor, the drive apparatus comprising:

a rotor coupled to the washing drum;

a supporting part connected to the rear wall of the suds container;

stator cores connected to said supporting part and projecting outwardly from said supporting part, each stator core having a core and a winding; and an electrical isolation layer disposed between the stator cores and the supporting part and electrically isolating the live parts of the motor from the rear wall of the suds container and said electrical isolation layer electrically isolating said stator cores from said supporting part and suppressing the flow of discharge currents between the stator cores and the supporting part.

2. The drive apparatus according to claim 1, wherein:

said supporting part includes a supporting element and a stator supporting part; and said isolation layer is disposed between said stator cores, said supporting element, and said stator supporting part.

3. The drive apparatus according to claim 1, including screws mounting said stator cores on said supporting part through screw holes having walls, said isolation layer isolating said walls from said stator core.

4. The drive apparatus according to claim 1, wherein:

said stator cores have field windings; and said supporting part has an outer wall opposite said field windings; and said isolation layer is disposed on said outer wall opposite said field windings.

5. The drive apparatus according to claim 1, wherein:

said stator cores have a slot insulation layer, laminated cores, and field windings; and said isolation layer supplements said slot insulation layer on said stator cores between said laminated cores and said field windings.

6. The drive apparatus according to claim 5, wherein said isolation layer entirely surrounds each of said laminated cores.

7. The drive apparatus according to claim 1, wherein said isolation layer is of a material selected from the group consisting of plastic; laminated paper; and a thermally conductive, electrically insulating film.

8. The drive apparatus according to claim 1, wherein said rotor of the motor is at least partially of an electrically insulating material suppressing high-frequency discharge currents.

9. The drive apparatus according to claim 8, wherein said rotor is entirely of plastic.

10. The drive apparatus according to claim 8, wherein said rotor is at least partially of plastic.

11. The drive apparatus according to claim 10, wherein said rotor has soft iron plates in said plastic.

12. The drive apparatus according to claim 10, wherein said rotor has soft iron plates injected molded in said plastic.

13. The drive apparatus according to claim 10, including soft iron plates adhesively bonded to said rotor.

14. The drive apparatus according to claim 10, including:

a shaft having an end connected to said rotor; and a metallic connecting element connecting said rotor to said shaft at said end.

15. The drive apparatus according to claim 14, wherein said connecting element is fixed rotatably by being injection molding in said plastic.

16. The drive apparatus according to claim 15, wherein said connecting element has a serrated tooth system.

17. The drive apparatus according to claim 10, including parts holding electrical connections in a given position, said rotor being disposed at a distance of more than 3 mm from said parts hold said electrical connections.

18. The drive apparatus according to claim 10, wherein said rotor has rounded edges.

19. The drive apparatus according to claim 10, wherein said rotor has ribs.

20. The drive apparatus according to claim 19, wherein said ribs are disposed on a side of said rotor facing said stator cores.

21. The drive apparatus according to claim 8, wherein: said rotor has permanent magnets; and soft iron plates are disposed adjacent said permanent magnets in said rotor as a magnetic return path.

22. The drive apparatus according to claim 8, wherein:

said rotor is a rotor bell having a flange and magnetic poles; and soft iron plates are disposed between said magnetic poles and said flange of said rotor bell.

23. The drive apparatus according to claim 1, wherein said rotor defines at least one of openings and apertures.

24. The drive apparatus according to claim 1, wherein said rotor is spoke-shaped.

25. The drive apparatus according to claim 1, wherein said rotor is a rotor bell.

26. A drive apparatus for a washing machine having a suds container with a rear wall, a motor disposed on the rear wall and having live parts electrically isolated from the suds container, and a washing drum driven by the motor, the drive apparatus comprising:

a rotor;

a supporting part;

stator cores connected to said supporting part and projecting outwardly from said supporting part, each stator core having a core and a winding;

an electrical isolation layer disposed between the stator cores and the rear wall and electrically isolating the live parts of the motor from the rear wall of the suds container and suppressing the flow of discharge currents between the stator cores and the rear wall;

a shaft connecting said rotor to the washing drum;

bearings surrounding said shaft; and said isolation layer isolating said supporting part from at least one of:

the rear wall;

said shaft driving the washing drum; and said bearings surrounding said shaft.

27. A drive apparatus for a washing machine having a suds container with a rear wall, a motor disposed on the rear wall and having live parts electrically isolated from the suds container, and a washing drum driven by the motor, the drive apparatus comprising:

a rotor to be connected to the washing drum;

a supporting part;

stator cores connected to said supporting part and projecting outwardly from said supporting part, each stator core having a core and a winding; and an electrical isolation layer disposed between the stator cores and the rear wall and electrically isolating the live parts of the motor from the rear wall of the suds container and suppressing the flow of discharge currents between the stator cores and the rear wall and said isolation layer entirely surrounding said supporting part.

28. In a washing machine having a suds container with a rear wall, a motor disposed on the rear wall and having live parts electrically isolated from the suds container, and a washing drum driven by the motor, the drive apparatus comprising:

a rotor connected to the washing drum;

a supporting part supporting said rotor;

stator cores connected to said supporting part and projecting outwardly from said supporting part, each stator core having a core and a winding; and an electrical isolation layer disposed between the stator cores and the supporting part 1 and electrically isolating the live parts of the motor from the rear wall of the suds container and suppressing the flow of discharge currents between the stator cores and the supporting part and said isolation layer electrically isolating said stator cores from said supporting part.

29. In a washing machine having a suds container with a rear wall, a motor disposed on the rear wall and having live parts electrically isolated from the suds container, and a washing drum driven by the motor, a drive apparatus comprising:

a rotor connected to the washing drum;

a supporting part supporting said rotor;

stator cores connected to said supporting part and projecting outwardly from said supporting part, each stator core having a core and a winding; and an electrical isolation layer electrically isolating the live parts of the motor from the rear wall of the suds container and suppressing the flow of discharge currents between the stator cores and the supporting part and said isolation layer electrically isolating said stator cores from said supporting part.

30. A drive apparatus for a washing machine having a suds container with a rear wall, a motor disposed on the rear wall and having live parts electrically isolated from the suds container, and a washing drum driven by the motor, the drive apparatus comprising:

a rotor;

a supporting part;

stator cores connected to said supporting part and projecting outwardly from said supporting part, each stator core having a core and a winding; and an electrical isolation layer disposed between the stator cores and the supporting part and electrically isolating the live parts of the motor from the rear wall of the suds container and said isolation layer entirely surrounding said supporting part and suppressing the flow of discharge currents between the stator cores and the supporting part.

* * * * *